US005240081A

United States Patent [19]

Milberger et al.

[11] Patent Number: 5,240,081

[45] Date of Patent: Aug. 31, 1993

[54] MUDLINE SUBSEA WELLHEAD SYSTEM

[75] Inventors: Lionel J. Milberger; Edward E. Thames, both of Houston, Tex.

[73] Assignee: ABB VetcoGray Inc., Houston, Tex.

[21] Appl. No.: 941,479

[22] Filed: Sep. 8, 1992

[51] Int. Cl.[5] ..... E21B 33/00

[52] U.S. Cl. ..... 175/8; 166/368

[58] Field of Search ..... 175/5, 8; 166/350, 351, 166/358, 359, 367, 368

[56] References Cited

U.S. PATENT DOCUMENTS

| | | | |
|---|---|---|---|
| 4,691,781 | 9/1987 | Gano | 166/368 |
| 4,742,874 | 5/1988 | Guillon | 166/368 X |
| 4,911,244 | 3/1990 | Hynes | 166/368 |
| 5,029,647 | 7/1991 | Milberger et al. | 166/368 X |
| 5,082,060 | 1/1992 | Johnson | 166/368 X |

OTHER PUBLICATIONS

Vetco Gray, SG-5XP 4-Hanger Wellhead System, VGi 1-155A (Feb. 1990).

Vetco Gray, MLC Mudline Suspension and Tieback System.

*Primary Examiner*—Thuy M. Bui

*Attorney, Agent, or Firm*—James E. Bradley

[57] ABSTRACT

A subsea well drilling and completion system allows the use of a jack-up rig for drilling with completion by a floater rig. The system uses an outer wellhead housing which is run on releasable conductor riser. An inner wellhead housing is lowered through the conductor riser and lands in the outer wellhead housing. Cement returns flow through a plurality of cement ports in the outer wellhead housing. A first hanger lands in the inner wellhead housing and supports an intermediate string of casing. The first hanger has a mudline profile in its interior. A second hanger supports a second string of casing and latches into the mudline profile. After drilling, tieback adapters are secured to each hanger for sealing to the inner wellhead housing.

17 Claims, 6 Drawing Sheets

MUDLINE SUBSEA WELLHEAD SYSTEM

BACKGROUND OF THE INVENTION

1. Field of the Invention

This invention relates generally to subsea well drilling, and in particular to a system that allows a well to be drilled from a jack-up rig and completed from a floater rig.

2. Description of the Prior Art

Subsea wells are typically drilled from either a jack-up rig, which is bottom supported, or a floater rig. When drilling from a jack-up rig, mudline suspension equipment is normally used. In a mudline suspension system, conductor pipe will be installed to a first depth in the well, usually by driving or jetting the conductor pipe. The conductor pipe, which is typically 30 inches in diameter, extends above the sea floor to the surface. The well will then be drilled to a second depth for receiving a string of outer casing, typically 20 inches in diameter.

A first hanger usually lands on a landing ring and shoulder provided in a hanger section located in the conductor pipe approximately at the sea floor. The first hanger supports the string of outer casing. Then after drilling the well deeper, a second hanger will latch into the first hanger, supporting an intermediate string of casing, typically 13⅜ inches in diameter. After drilling deeper, a third hanger will support an inner string of casing, typically 9⅝ inches in diameter. In some cases another string of casing will be run inside the 9⅝ casing.

Each string of casing has a riser section extending from the mudline hanger to the surface vessel. The blowout preventer stack will be located at the surface on the drilling rig. The various hangers do not seal to each other at the subsea floor, rather simply latch in place.

After drilling and testing of the well is completed, it is usually temporarily abandoned. Generally in the prior art, after the mudline suspension system well is abandoned, then it will be tied back to a high pressure housing adapter. The wellhead adapter is located subsea. At least one casing hanger annulus permanent seal will be installed in the high pressure wellhead adapter. These installations are all done using a jack-up rig. Then, a high pressure riser is connected between the adapter and the rig, and a blowout preventer is located at the surface to allow running of a tubing hanger.

In a subsea wellhead system drilled by a floater, an outer wellhead housing will be supported on a guide base at the subsea floor. The conductor pipe secures to the lower end of the outer wellhead housing and does not extend to the surface. After drilling the well for 20 inch casing, a high pressure or inner wellhead housing lands in the outer wellhead housing. The 20 inch casing secures to the lower end of the high pressure wellhead housing. A riser extending to the floater at the surface will then be connected to the inner wellhead housing. A subsea blowout preventer stack locates in the riser near the sea floor.

After drilling the well for each string of casing, a subsea casing hanger lands in the inner wellhead housing. Casing hanger seals are employed to seal between the casing hangers and the high pressure wellhead housing as each string of casing is run. During drilling with subsea wellhead equipment, no casing access to the surface is necessary since the blowout preventer stack is located atop the high pressure wellhead housing.

For economic reasons that currently exist, it would be desirable to drill a well from a jack-up drilling rig and complete the well for production from a floater rig. Various techniques to accommodate this rig change have been proposed, but they are expensive and cumbersome. The conversion equipment is extensive and consists of numerous pieces. One problem is that the equipment must be designed so that the subsea blowout preventer stack required for completion by a floater will be supported by the conductor pipe. A typical mudline suspension system may not be able to accommodate the large bending moments generated by the floater through the riser, ball joint, blowout preventer stack. As the mudline suspension system lacks an outer wellhead housing, the conductor pipe is required to support these large bending moments. Adaptations to provide this support are difficult, expensive to install, and are peculiar to each well installation.

At least in one instance, a well was drilled wherein after the drilling, a subsea high pressure wellhead profile was in place to accept a subsea blowout preventer stack to be run from a floater. In that well, no outer wellhead housing was used. A special casing hanger was employed to land in the conductor pipe, the casing hanger having a larger diameter casing riser extending upward than the casing extending below. A high pressure wellhead secured to the casing riser. A high pressure riser was run above the high pressure wellhead.

There were several shortcomings in that prior technique, one of which required a different diameter of casing below the high pressure wellhead than above. It also required overshot washout sleeves, which are expensive and have marginal performance. Also the wellhead was smaller in diameter than of a type preferred.

SUMMARY OF THE INVENTION

In this invention, an outer wellhead housing is employed in the mudline suspension portion of the well. The outer wellhead housing secures to a conductor pipe on the lower end. A conductor riser of the same type as the conductor pipe connects through a releasable connector to the upper end of the outer wellhead housing. A cement return port extends through the outer wellhead housing. The well is then drilled for an outer or 20 inch casing string. The cement return port is closed by a retrievable sleeve during this drilling so that cuttings return up the conductor riser to the drilling rig. The closure sleeve for the cement return port is then retrieved. In some drilling environments, it may be acceptable to waste the drilling return to the sea because of lack of contamination. In this case the ports may remain open.

A high pressure inner wellhead housing is then lowered through the conductor riser and installed in the outer wellhead housing. The inner wellhead housing latches in place. The first or outer string of casing, which secures to the inner wellhead housing, is cemented, with cement returns returning out the cement return port. A seal located above the cement port prevents any returns from entering the area between the conductor riser and the high pressure wellhead housing.

Then, after drilling the well to the next depth, a first mudline style hanger lands on a landing shoulder in the high pressure housing. The first hanger secures to an intermediate string of casing and is run on intermediate casing riser. The first hanger has a mudline latch profile in its interior.

After the intermediate string is cemented and the well drilled to a greater depth, a second hanger is latched into the mudline suspension latch profile of the outer hanger. The second hanger supports a string of casing and is run on an inner casing riser. After the well has been drilled to the total depth, all of the risers are removed. The well is capped and the jack-up drilling rig moved from location.

Subsequently, a floater vessel may be positioned to complete the well. The outer wellhead housing has an outer profile with lockdown and orientation provisions to accept a remote installed guide structure. A four post guideline structure or a guideline less style structure is installed on the outer wellhead housing. After installation of the guide structure and removal of the cap, the floater connects a riser and blowout preventer stack to the inner wellhead housing. The floater then lowers a first or outer tieback adapter onto the first hanger. The first tieback adapter sealingly engages the bore of the first hanger and has an external cylindrical sealing surface. A conventional casing hanger seal seals between the high pressure wellhead housing and the first tieback adapter.

Then, the operator lowers an inner or second tieback adapter, which has a lower section that extends down into and seals in the bowl of the second hanger. The second tieback adapter has a threaded ring that lands on the first tieback adapter. Rotating the ring will apply tension to the second tieback adapter. A conventional seal is used to seal between the second tieback adapter and the inner wellhead housing. The second tieback adapter has a bowl that is configured to receive a tubing hanger. The well is completed with tubing and a tree in a conventional manner.

DETAILED DESCRIPTION OF THE INVENTION

Figure 1A:
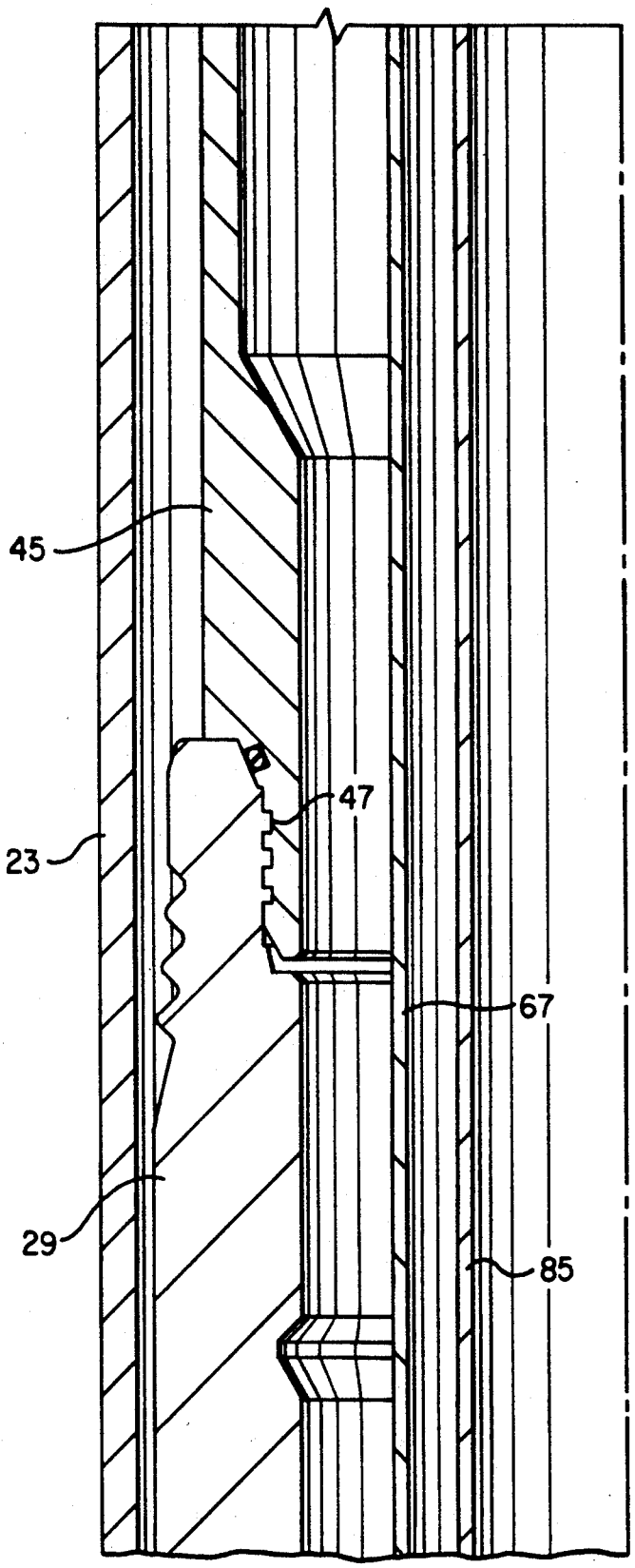
FIGS. 1*a*, 1*b* and 1*c* are a quarter vertical sectional view of a wellhead system constructed in accordance with this invention and shown during a drilling phase.
Figure 1B:
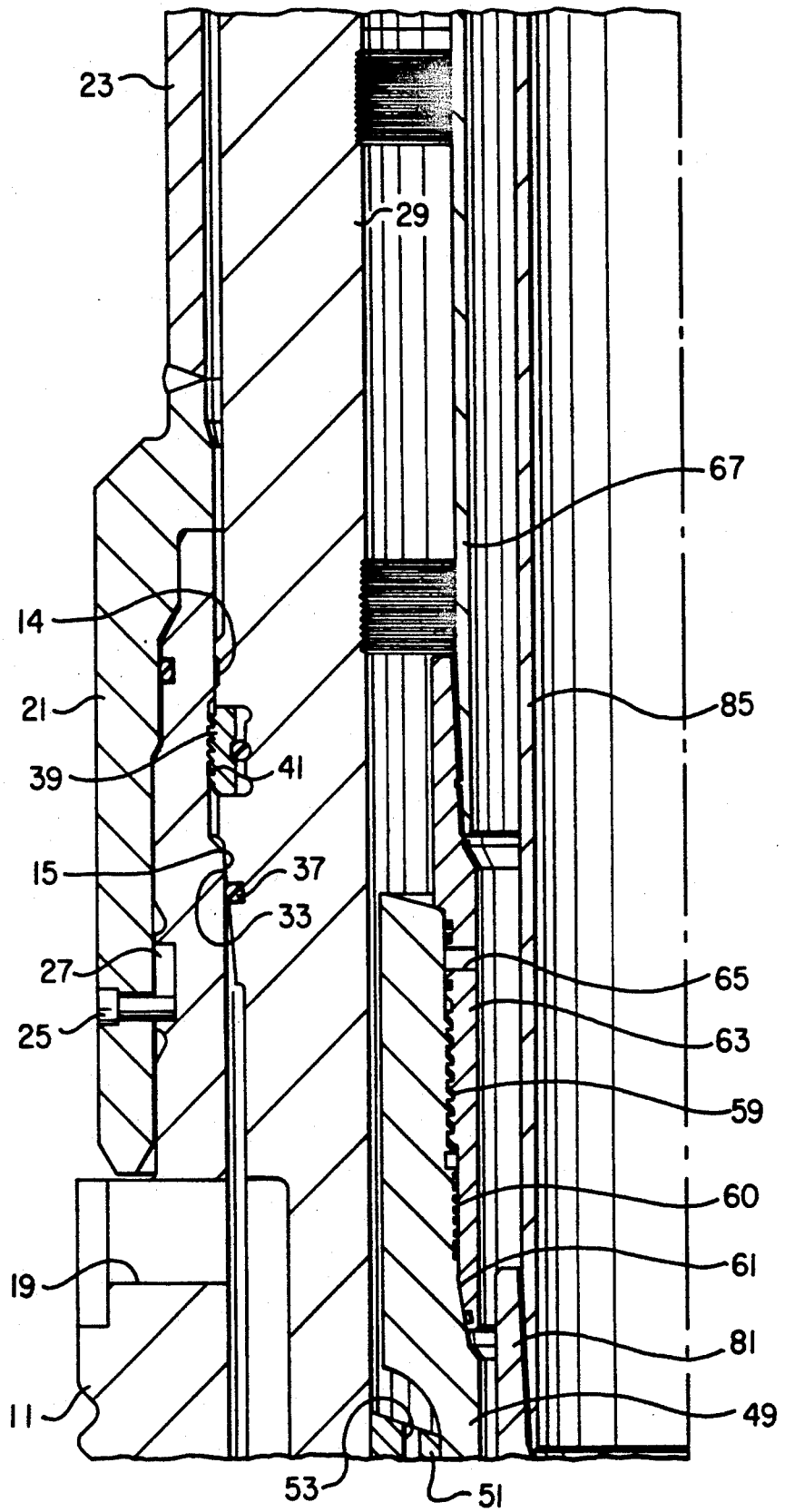
Figure 1C:
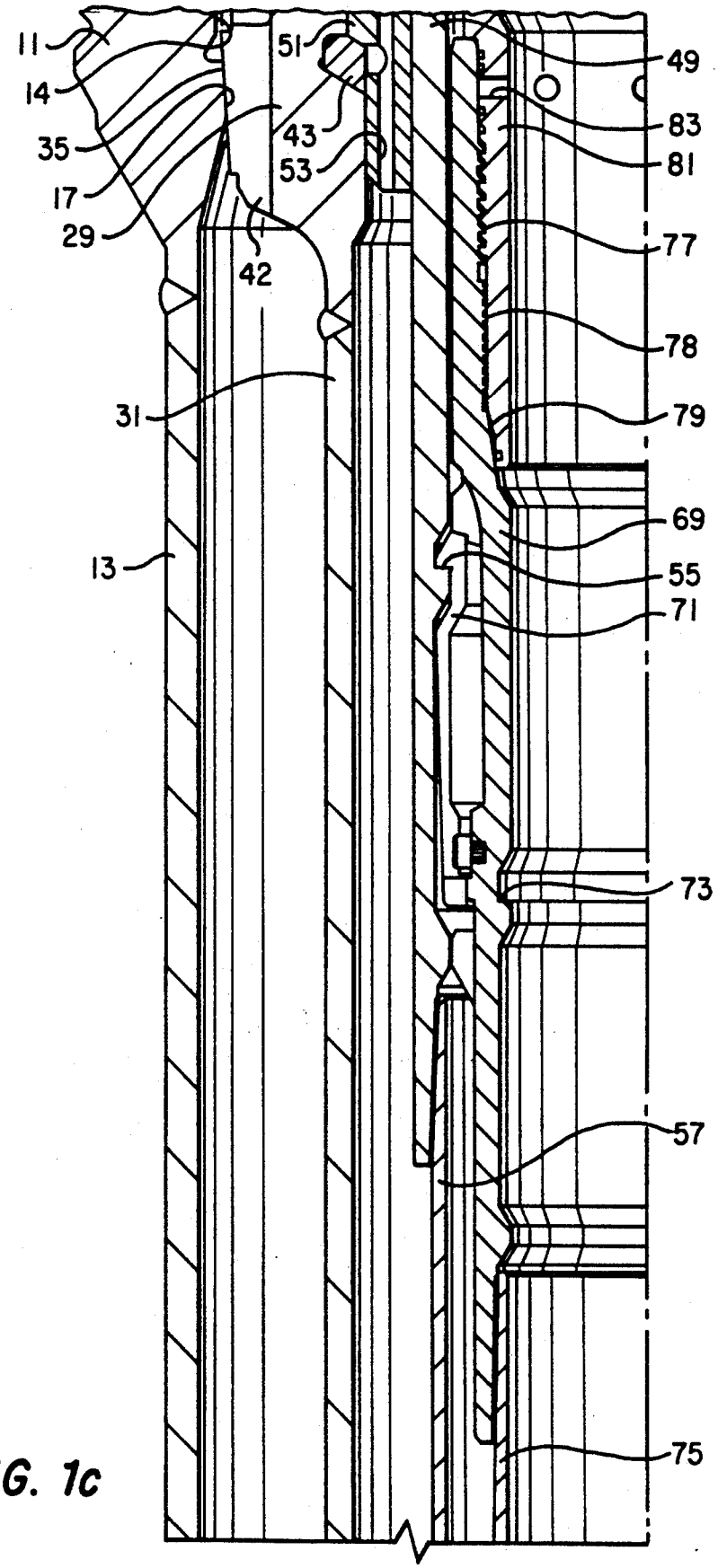

Referring to FIGS. 1*b* and 1*c*, the wellhead system includes an outer wellhead housing 11. Outer wellhead housing 11 is a large tubular member having conductor pipe 1 secured to its lower end. The wall thickness of outer wellhead housing 11 is several times that of the wall thickness of conductor pipe 13. Outer wellhead housing 11 has an axial bore 14. Two axially spaced apart conical tapers 15, 17 are located in bore 14. A plurality of cement return ports 19 (only one shown) extend through the sidewall of outer wellhead housing 11 between tapers 15, 17.

A riser connector 21 secures to the exterior of outer wellhead housing 11 and connects to a string of conductor riser 23. Conductor riser 23 is the same type and size as the conductor pipe 13, typically 30 inches in diameter. Riser connector 21 allows conductor riser 23 to be released from outer wellhead housing 11. The connection means includes several J-lugs (not shown) which engage a J-slots 27 located on the exterior of outer wellhead housing 11. An anti-rotation shear pin 25 secures to riser connector 21 and engages wellhead housing 11. The outer wellhead housing 11 will be located at the sea floor, and will be run in with the conductor riser 23 from a jack-up drilling rig. This may be accomplished by driving, jetting or drilling.

After the outer wellhead housing 11 is installed, the well will be drilled to a greater depth. Preferably a protective sleeve (not shown) is located over cement return ports 19 during this drilling phase. Cuttings will return to the jack-up drilling rig through the conductor riser 23. The protective sleeve is removed after drilling through the conductor pipe 13.

Then, an inner wellhead housing 29 will be lowered in place. Inner wellhead housing 29 secures to a string of outer casing 31, typically 20 inches in diameter. Inner wellhead housing 29 has two external tapers 33, 35, which tightly and slidingly engage the internal tapers 15, 17 in outer wellhead housing 11. A seal 37 is located on the exterior of inner wellhead housing 29 for sealing the upper taper 15 above the cement return ports 19. A latch 39 engages grooves 41 formed in the bore 14 of outer wellhead housing 11. Flutes 42 on the exterior of inner wellhead housing 29 (FIG. 1*c*) allow cement returns to flow up and out cement return ports 19.

Inner wellhead housing 29 is a high pressure wellhead housing, having a load shoulder 43 for supporting casing weight and pressure. In the embodiment shown, load shoulder 43 is a separate hard metal insert ring located in a groove in the bore of inner wellhead housing 29.

Referring to FIG. 1*a*, an outer casing riser 45 secures to internal threads 47 in the interior of inner wellhead housing 29. Outer casing riser 45 secures to casing that is the same wall thickness and diameter as the outer casing 31. Outer casing riser 45 can be of a larger size if the wall thickness used requires a drift diameter to be compatible with the bore of inner wellhead housing 29. Outer casing riser 45 extends to the drilling vessel. Cement will be pumped down outer casing riser 45, with returns flowing between the conductor pipe 13 and outer casing 31. The returns will flow out the cement return ports 19.

The well will then be drilled to a greater depth, with cuttings returning up the outer casing riser 45. Then, a first hanger 49 will be lowered into the inner wellhead housing 29. In the embodiment shown, first hanger 49 has a load ring 51 on its exterior which provides a downward facing shoulder for landing on shoulder 43 of inner wellhead housing 29. Load ring 51 has a plurality of flow passages 53 extending axially therethrough for allowing cement returns. First hanger 49 has a mudline profile 55 in its interior. Mudline profile 55 comprises a pair of axially spaced apart annular grooves. A string of intermediate casing 57, typically 13⅝ inch, secures to the lower end of first hanger 49.

First hanger 4 also has conventional tieback threads 59, 60 formed in its interior as shown in FIG. 1*b*. Threads 59 are slightly greater in diameter and located above threads 60. An internal sealing surface 61 that is tapered locates below the tieback threads 60.

A running tool 63 is employed to run the first hanger 49. Running tool 63 has mating threads for engaging tieback threads 59. Running tool 63 has a lower section that extends over threads 60 and sealingly engages sealing surface 61 in a metal-to-metal seal. A plurality of wash ports 65 are located in running tool 63. Unscrewing running tool 63 partially exposes wash ports 65 to enable fluid to be pumped down an intermediate casing riser 67 and to flow back up the surrounding annulus.

Intermediate casing riser 67 is of the same diameter and type as intermediate casing 57.

After the well has been drilled through intermediate casing riser 67 and intermediate casing 57 to a greater depth, a second hanger 69 lands in the first hanger 49. Second hanger 69 has an external collet 71 that will latch into the mudline profile 55, as shown in FIG. 1*c*. Second hanger 69 may also have an interior mudline profile 73 if an additional string of casing is to be run (not shown). Second hanger 69 secures to a string of inner casing 75, which is preferably 9⅝ inch in diameter. Second hanger 69 has a similar set of internal tieback threads 77, 78. Tieback threads 77 are located above and are greater in diameter than tieback threads 78. An internal sealing surface 79 locates below tieback threads 78.

A running tool 81 is employed to run second hanger 69. Running tool 81 secures to tieback threads 77 and has a lower portion that extends over tieback threads 78 and sealingly engages internal sealing surface 79. Running tool 81 has wash ports 83. Wash ports 83 are shown blocked, but will locate above second hanger 69 when running tool 81 is unscrewed partially so as to allow cement to be cleaned from the annulus area between an inner casing riser 85 and intermediate casing riser 67. The inner casing riser 85 secures to running tool 81 and is the same diameter and size as inner casing 75.

After the well has been drilled to total depth and the inner casing 75 cemented in place, the operator will remove the inner casing riser 85, running tool 81, intermediate casing riser 67, running tool 63, outer casing riser 45, and conductor riser 23. The operator will install a protective cap on the inner wellhead housing 29 and move the jack-up drilling rig from the location.

Subsequently for completion by a floater, the floater will be positioned over the subsea well and the protective cap (not shown) on the inner wellhead housing 29 removed. Then, a conventional subsea blowout preventer stack (not shown) will be lowered over and connected to the exterior of inner wellhead housing 29. The blowout preventer stack is lowered with a riser string.

Then, a first tieback adapter 87 (FIG. 2*b*) will be lowered on a running tool (not shown). First tieback adapter 87 lands on the upper end of first hanger 49. First tieback adapter 87 has external threads 89 that engage the tieback threads 60 of first hanger 49. First tieback adapter 87 has a lower end 91 that is configured as a seal for sealingly engaging the internal sealing surface 61 of first hanger 49. First tieback adapter 87 has a generally cylindrical external surface that is spaced inward from the inner wall of inner wellhead housing 29, defining an annulus. A conventional casing hanger seal 95 is installed in this annular space. Casing hanger seal 95 may be of a type shown in U.S. Pat. No. 4,932,472.

Figure 2A:
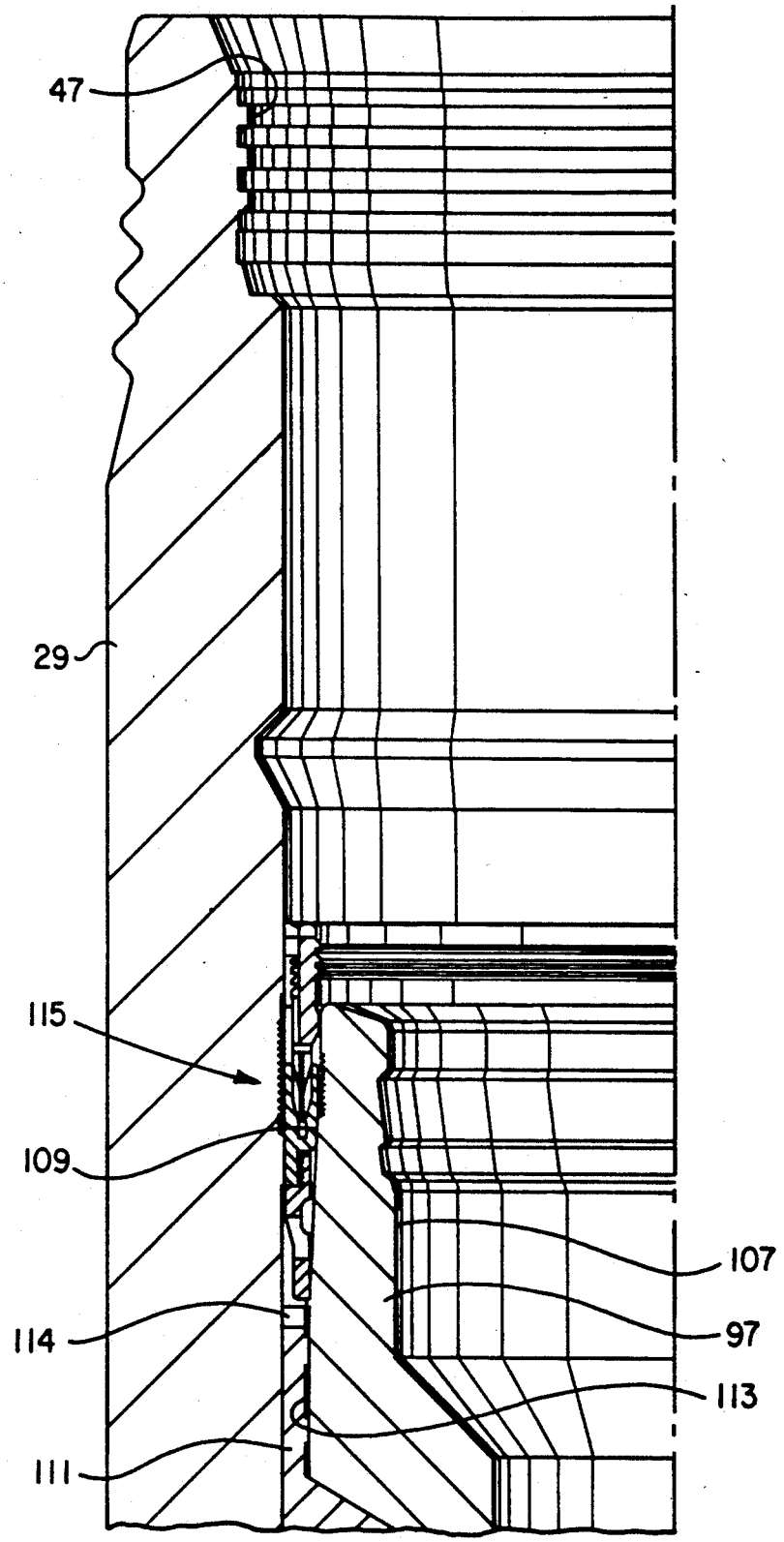
FIGS. 2*a*, 2*b* and 2*c* are a quarter vertical sectional view of the wellhead system of FIG. 1, but showing the system in a tieback completion phase.
Figure 2B:
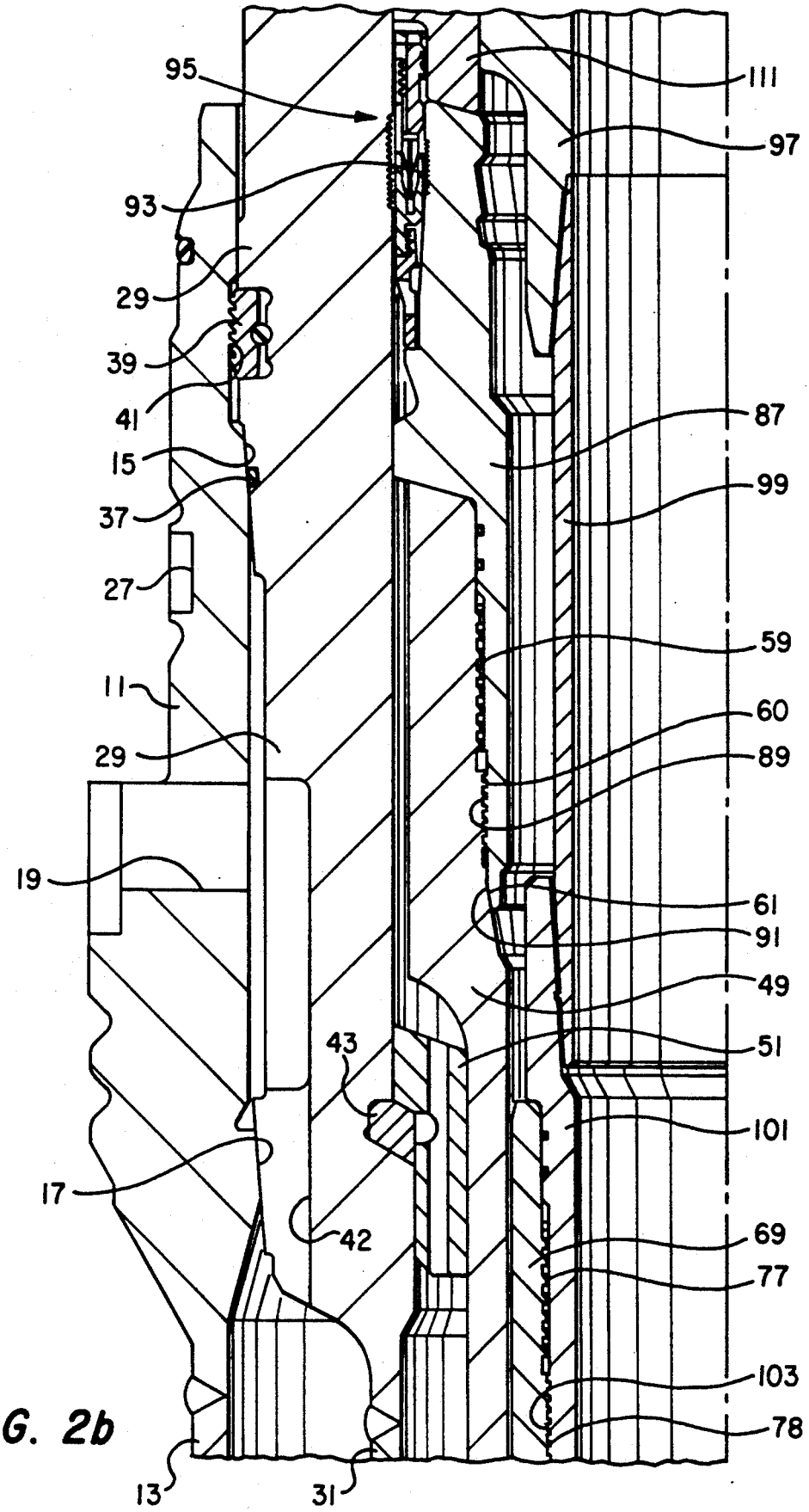
Figure 2C:
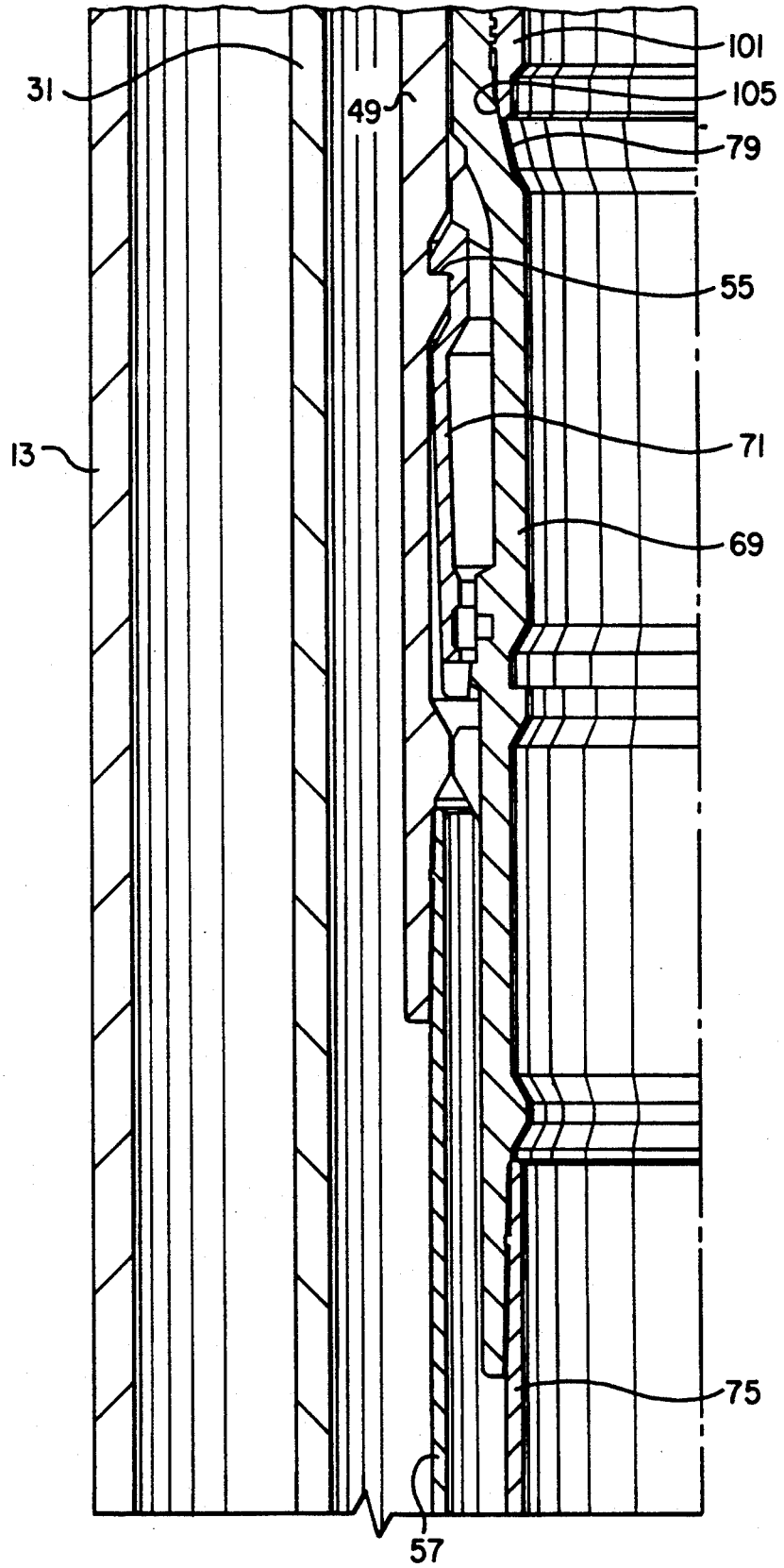

Then, as shown in FIGS. 2*a*, 2*b* and 2*c*, a second tieback member 97 is installed. Second tieback member 97 has an extension section 99 extending downward. A lower section 101 joins extension section 99. Lower section 101 has external threads 103 that engage tieback threads 78 of second hanger 69. The lower end 105 of lower section 101 (FIG. 2*c*) is configured as a seal for sealingly engaging internal sealing surface 79 of second hanger 69. Second tieback member 97 has a tubing hanger bowl 107 in its interior for receiving a tubing hanger (not shown) subsequently. Second tieback member 97 has an external sealing surface 109 that is spaced inward from the inner wall of inner wellhead housing 29, defining an annulus.

A threaded ring 111 secures to threads 113 on the exterior of second tieback member 97 below sealing surface 109. Threaded ring 111 lands on the upper end of first tieback adapter 87 as shown in FIG. 2*b*, the upper end serving as a bearing surface for ring 111. A running tool (not shown) will engage lugs 114 on the upper end of threaded ring 111 to tighten it by rotation. This applies tension in the tieback member 97, including its extension section 99 and lower section 101. A conventional casing hanger seal 115 will seal in the annular space between external sealing surface 109 and inner wellhead housing 29.

In operation, referring to FIGS. 1*b* and 1*c*, initially a jack-up drilling rig will install conductor pipe 13 by drilling, jetting or driving. Outer wellhead housing 11 will locate at the sea floor and conductor riser 23 (FIG. 1*a*) will extend to the vessel.

The well then will be drilled for outer casing 31, with cuttings returning up the conductor riser 23, the cement return ports 19 being blocked by a sleeve (not shown). Then, the sleeve will be removed and the outer casing 31 installed, with inner wellhead housing 29 landing in the tapers 15, 17. Outer casing 31 will be cemented in place, with cement returns returning out the cement return ports 19. Seal 37 prevents any cement returns from flowing upward past the upper taper 15.

Then, the operator drills to a depth for intermediate casing 57. The operator runs intermediate casing 57, landing first hanger 49 on the load shoulder 43 of inner wellhead housing 29. Intermediate casing 57 will be run on intermediate casing riser 67. Once cementing has been completed, the operator will unscrew running tool 63 slightly and pump fluid down intermediate casing riser 67 to flow through wash ports 65 to wash the annular space surrounding intermediate casing riser 67.

The operator then retightens running tool 63 and drills the well through intermediate casing riser 57 to a depth for inner casing 75. The operator runs inner casing 75 on second hanger 69 and inner casing riser 85. Second hanger 69 latches into profile 55. After cementing, the operator partially unscrews running tool 81 to expose wash ports 83 for cleaning the annulus space surrounding inner casing riser 85. After testing of the well, the operator then removes the inner casing riser 85, intermediate casing riser 67, outer casing riser 45 and conductor riser 21. The operator installs a protective cap and removes the jack-up drilling rig.

The operator then places a floater rig over the well for final completion. The outer wellhead housing 11 has an outer profile with lockdown and orientation provisions (not shown) to accept a remote installed guide structure. A four post guideline structure or a guideline less style structure (not shown) is installed on the outer wellhead housing 11. After installation of the guide structure and removal of the cap, the operator installs a conventional high pressure riser with subsea blowout preventer stack (not shown) onto the inner wellhead housing 29. The operator installs first tieback adapter 87 (FIG. 2*b*) and a casing hanger seal 95. The operator installs second tieback member 97, tensioning it through threaded ring 111 (FIG. 2*a*). The operator installs casing hanger seal 115. The operator then is in position for testing the well an installing tubing.

The invention has significant advantages. The invention readily allows a well to be drilled with a jack-up rig then completed with a floater rig. After drilling by the jack-up, an upward facing profile for subsea well completion will be in place. The inner wellhead housing and outer wellhead housing will accommodate large bending forces and axial loads of a type that occur with floating rigs that use a subsea blowout preventer. The cement return ports located between the tapers of the outer wellhead housing allow cutting returns to be returned to the surface during drilling for the outer casing. Unlike the prior art, there is no need for installing adapters to connect a high pressure wellhead housing above the mudline completion system. The system provides the operator with a known stack-up height for installing a tubing hanger. The system also eliminates the need for a high pressure riser for installing the tubing hanger.

While the invention has been shown in only one of its forms, it should be apparent to those skilled in the art that it is not so limited but is susceptible to various changes without departing from the scope of the invention.

I claim:

1. In a subsea wellhead system, an improved means for allowing the well to be drilled with a mudline suspension system and completed with a subsea pressure control system, comprising in combination:

an outer wellhead housing for location on a subsea floor, having a lower end adapted to be secured to a conductor pipe extending into the well;

conductor connector means for releasably securing a string of conductor riser of the same size and type as the conductor pipe to the outer wellhead housing to extend to the surface;

a cement return port extending through the outer wellhead housing;

an inner wellhead housing having a lower end adapted to be secured to a string of outer casing, the inner wellhead housing having a bore containing an internal landing shoulder;

outer casing connector means for connecting the inner wellhead housing to outer casing riser and for lowering the outer casing riser and inner wellhead housing through the conductor riser with the inner wellhead housing landing in the outer wellhead housing;

seal means for sealing the inner wellhead housing to the outer wellhead housing above the cement return port to prevent cement returns from flowing up between the inner wellhead housing and the conductor riser above the cement return port;

a first casing hanger having a lower end adapted to be secured to an intermediate string of casing extending through the string of outer casing into the well, the first casing hanger having an external downward facing shoulder that lands on the internal landing shoulder in the inner housing, the first casing hanger having an internal mudline latch profile;

intermediate casing connector means for running the first casing hanger and connecting the first casing hanger to a string of intermediate casing riser extending through the outer casing riser to the surface;

a second casing hanger having a lower end adapted to be secured to an inner string of casing extending through the string of intermediate casing into the well, the second casing hanger having an external latch that latches into the internal mudline latch profile in the first casing hanger;

inner casing connector means for running the second casing hanger and connecting the second casing hanger to a string of inner casing riser that extends through the intermediate casing riser to the surface; and the conductor riser, outer casing riser, intermediate casing riser, and inner casing riser allowing the well to be drilled with a mudline suspension system and pressure control equipment at the surface, the inner casing connector means, intermediate casing connector means, outer casing connector means, and conductor connector means being subsequently releasable to remove the inner casing riser, intermediate casing riser, outer casing riser and conductor riser for subsea pressure control completion.

2. The subsea wellhead system according to claim 1, further comprising:

first tieback means installable after the inner casing riser, intermediate casing riser, outer casing riser and conductor riser have been removed for sealing the first casing hanger to the bore of the inner wellhead housing; and second tieback means installable after the first tieback means has sealed the first casing hanger for sealing the second casing hanger to the bore of the inner wellhead housing at a point above the first casing hanger.

3. The subsea wellhead system according to claim 1 wherein the outer wellhead housing has two axially spaced apart internal tapers for supporting the inner wellhead housing, and wherein the cement return port locates between the two tapers.

4. In a subsea wellhead system, an improved means for allowing the well to be drilled with a mudline suspension system and completed with a subsea pressure control system, comprising in combination:

an outer wellhead housing adapted to be located at a subsea floor, having a lower end adapted to be secured to a conductor pipe extending into the well;

conductor connector means for releasably securing a string of conductor riser of the same size and type as the conductor pipe to the outer wellhead housing to extend to the surface;

a cement return port extending through the outer wellhead housing;

an inner wellhead housing having a lower end adapted to be secured to a string of outer casing, the inner wellhead housing having an axial bore and an internal landing shoulder;

outer casing connector means for connecting the inner wellhead housing to outer casing riser of the same size and type as the outer casing and for lowering the outer casing riser and inner wellhead housing through the conductor riser with the inner wellhead housing landing in the outer wellhead housing;

seal means for sealing the inner wellhead housing to the outer wellhead housing above the cement return port to prevent cement returns from flowing up between the inner wellhead housing and the conductor riser above the cement return port;

a first casing hanger having a lower end adapted to be secured to an intermediate string of casing extending through the string of outer casing into the well, the first casing hanger having an external downward facing shoulder that lands on the internal landing shoulder in the inner housing, the first casing hanger having an internal sealing surface and an internal mudline latch profile;

intermediate casing connector means for running the first casing hanger and connecting the first casing hanger to a string of intermediate casing riser extending through the outer casing riser to the surface;

a second casing hanger having a lower end adapted to be secured to an inner string of casing extending through the string of intermediate casing into the well, the second casing hanger having an external latch that latches into the internal mudline latch profile in the first casing hanger, the second casing hanger having an internal sealing surface;

inner casing connector means for running the second casing hanger and connecting the second casing hanger to a string of inner casing riser that extends through the intermediate casing riser to the surface;

the conductor riser, outer casing riser, intermediate casing riser, and inner casing riser allowing the well to be drilled with a mudline suspension system and pressure control equipment at the surface, the inner casing connector means, intermediate casing connector means, outer casing connector means, and conductor connector means being subsequently releasable to remove the inner casing riser, intermediate casing riser, outer casing riser and conductor riser for subsea pressure control completion;

a first tieback member installable after the inner casing riser, intermediate casing riser, outer casing riser and conductor riser have been removed, the first tieback member having a lower end that secures to and sealingly engages the internal sealing surface of the first casing hanger, the first tieback member having an external sealing surface spaced above the first casing hanger;

first tieback seal means for sealing the external sealing surface of the first tieback member to the bore of the inner wellhead housing;

a second tieback member installable after the first tieback member has been installed, the second tieback member having a lower end that secures to and sealingly engages the internal sealing surface of the second casing hanger, the second tieback member having an external sealing surface spaced above the external sealing surface of the first tieback member; and second tieback seal means for sealing the external sealing surface of the second tieback member to the bore of the inner wellhead housing.

5. The subsea wellhead system according to claim 4 wherein the outer wellhead housing has two axially spaced apart internal tapers for supporting the inner wellhead housing, and wherein the cement return port locates between the two tapers.

6. The subsea wellhead system according to claim 4, further comprising tensioning means for tensioning the second tieback member.

7. The subsea wellhead system according to claim 4, further comprising tensioning means for tensioning the second tieback member comprising:

a set of external threads on the second tieback member; and a threaded ring secured to the threads, having a lower end which contacts an upper end of the first tieback member, so as to tension the second tieback member by rotating the ring.

8. A method for drilling a subsea well, comprising in combination:

providing an outer wellhead housing with a cement return port extending through a side wall of the outer wellhead housing;

securing a string of conductor pipe to a lower end of the outer wellhead housing, connecting a conductor riser to the outer wellhead housing, running the conductor pipe into the well, and locating the outer wellhead housing at a subsea floor with the conductor riser extending upward to a drilling rig; then drilling the well deeper through the conductor riser and conductor pipe;

providing an inner wellhead housing with an internal landing shoulder;

securing a lower end of the inner wellhead housing to a string of outer casing and an upper end to an outer casing riser, and running the string of outer casing with the outer casing riser through the conductor riser, outer wellhead housing and conductor pipe; then landing the inner wellhead housing in the outer wellhead housing, sealing the inner wellhead housing to the outer wellhead housing above the cement return port, and cementing the outer string of casing, with cement returns flowing through the cement return port; then drilling the well deeper through the outer casing; then providing a first hanger having an external landing shoulder and an internal mudline profile, securing a lower end of the first hanger to a string of intermediate casing and an upper end to an intermediate casing riser, and running the string of intermediate casing through the outer casing riser into the well and landing the external landing shoulder of the first hanger on the internal landing shoulder of the inner wellhead housing; then cementing the string of intermediate casing and drilling the well deeper through string of intermediate casing; then providing a second hanger having an external latch, securing a lower end of the second hanger to a string of inner casing, and running the string of inner casing through the string of intermediate casing into the well and latching the second hanger to the mudline profile in the first hanger; then removing the inner casing riser, intermediate casing riser, outer casing riser, and conductor riser.

9. The method according to claim 8 further comprising after removal of the inner casing riser, intermediate casing riser, outer casing riser, and conductor riser:

sealing the first hanger to the inner wellhead housing; then sealing the second hanger to the inner wellhead housing.

10. The method according to claim 8 wherein during the step of drilling the well deeper through the conductor pipe, the cement return port is blocked and drilling fluid is returned up through the conductor riser.

11. The method according to claim 9 wherein the step of sealing the first hanger to the inner wellhead housing comprises:

providing an internal grooved profile in the first hanger and an internal sealing surface in the first hanger;

providing a first tieback member, engaging a lower end of the first tieback member with the internal grooved profile in the first hanger and engaging a lower end of the first tieback member with the internal sealing surface in the first hanger; then sealing an exterior surface of the first tieback member to the inner wellhead housing.

12. The method according to claim 11, wherein the step of sealing the second hanger to the inner wellhead housing comprises:

providing an internal grooved profile in the second hanger;

providing a second tieback member, engaging a lower end of the second tieback member with the internal grooved profile in the second hanger and engaging a lower end of the second tieback member with the internal sealing surface in the second hanger; then sealing an exterior surface of the second tieback member to the inner wellhead housing at a point above the first tieback member.

13. The method according to claim 12 further comprising tensioning the second tieback member prior to sealing the external surface of the second tieback member to the inner wellhead housing.

14. The method according to claim 13 wherein the step of tensioning the second tieback member comprises:

providing a set of threads on the exterior of the second tieback member;

providing a threaded ring and securing the threaded ring to the threads on the inner extension member;

providing a bearing surface in the inner wellhead housing;

landing the ring on the bearing surface and tightening the ring against the bearing surface to tension the inner extension member.

15. A method for drilling a subsea well, comprising in combination:

providing an outer wellhead housing with a cement return port extending through a side wall of the outer wellhead housing;

securing a string of conductor pipe to a lower end of the outer wellhead housing, connecting a conductor riser to the outer wellhead housing, running the conductor pipe into the well with the conductor riser, and locating the outer wellhead housing at a subsea floor with the conductor riser extending upward to a drilling rig; then drilling the well deeper through the conductor riser and conductor pipe;

providing an inner wellhead housing with a bore having an internal landing shoulder;

securing a lower end of the inner wellhead housing to a string of outer casing and an upper end to an outer casing riser, and running the string of outer casing with the outer casing riser through the conductor riser, outer wellhead housing and conductor pipe; then landing the inner wellhead housing in the outer wellhead housing, sealing the inner wellhead housing to the outer wellhead housing above the cement return port, and cementing the outer string of casing, with cement returns flowing through the cement return port; then drilling the well deeper through the outer casing; then providing a first hanger having an external landing shoulder and an internal mudline profile, securing a lower end of the first hanger to a string of intermediate casing and an upper end to an intermediate casing riser, and running the string of intermediate casing through the outer casing riser into the well and landing the external landing shoulder of the first hanger on the internal landing shoulder of the inner wellhead housing; then cementing the string of intermediate casing and drilling the well deeper through the string of intermediate casing; then providing a second hanger having an external latch, securing a lower end of the second hanger to a string of inner casing, and running the string of inner casing through the string of intermediate casing into the well and latching the second hanger to the mudline profile in the first hanger; then removing the inner casing riser, intermediate casing riser, outer casing riser, and conductor riser; then sealing the first hanger to the inner wellhead housing; then sealing the second hanger to the inner wellhead housing.

16. The method according to claim 15 wherein the step of sealing the first hanger to the inner wellhead housing comprises:

providing an internal grooved profile in and an internal sealing surface in the first hanger;

providing a first tieback member having a lower end containing an external grooved profile and a seal and an upper end having an external sealing surface; then engaging the external grooved profile of the first tieback member with the internal grooved profile of the first hanger, and engaging the seal of the first tieback member with the internal sealing surface of the first hanger, and sealing the external sealing surface of the first tieback member to the inner wellhead housing.

17. The method according to claim 15 wherein the step of sealing the first hanger to the inner wellhead housing comprises:

providing an internal grooved profile in the first hanger and an internal sealing surface;

providing an first tieback member having a lower end containing an external grooved profile and a seal and an upper end having an external sealing surface; then engaging the external grooved profile of the first tieback member with the internal grooved profile of the first hanger, and engaging the seal of the first tieback member with the internal sealing surface of the first hanger, and sealing the external sealing surface of the first tieback member to the inner wellhead housing; and wherein the step of sealing the second hanger to the inner wellhead housing comprises:

providing an internal grooved profile and internal sealing surface in the second hanger;

providing a second tieback member having a lower end containing an external grooved profile and a seal, a bowl for receiving a tubing hanger, and an upper end having an external sealing surface;

providing a set of threads on the exterior of the second tieback member below the external sealing surface;

providing a threaded ring and securing the threaded ring to the threads on the second tieback member;

engaging the external grooved profile of the second tieback member with the internal grooved profile of the second hanger, and engaging the seal of the second tieback member with the internal sealing surface of the second hanger, landing the threaded ring on the first tieback member and rotating the threaded ring to tension the second tieback member; then sealing the external sealing surface of the second tieback member to the inner wellhead housing.

* * * * *